US010967282B2

(12) United States Patent
Groels

(10) Patent No.: US 10,967,282 B2
(45) Date of Patent: Apr. 6, 2021

(54) ATTRACTION FOR ENTERTAINMENT RIDES

(71) Applicant: K.I.G. Heerenveen B.V., Terband-Heerenveen (NL)

(72) Inventor: Hendrikus Maria Petro Johannes Helena Groels, Valkenswaard (NL)

(73) Assignee: K.I.G. Heerenveen B.V., Terband-Heerenveen (NL)

( * ) Notice: Subject to any disclaimer, the term of this patent is extended or adjusted under 35 U.S.C. 154(b) by 0 days.

(21) Appl. No.: 16/593,114

(22) Filed: Oct. 4, 2019

(65) Prior Publication Data

US 2020/0108323 A1 Apr. 9, 2020

(30) Foreign Application Priority Data

Oct. 8, 2018 (NL) ..... 2021772

(51) Int. Cl.
*A63G 31/06* (2006.01)
*A63G 1/06* (2006.01)
(Continued)

(52) U.S. Cl.
CPC *A63G 1/06* (2013.01); *A63G 1/08* (2013.01)

(58) Field of Classification Search
CPC ... A63G 1/00; A63G 1/24; A63G 1/26; A63G 4/00; A63G 1/06; A63G 1/08; A63G 1/10; A63G 1/28
(Continued)

(56) References Cited

U.S. PATENT DOCUMENTS 1,520,592 A * 12/1924 Mongillo ..... A63G 1/26 472/31
4,007,926 A * 2/1977 Ottaway ..... A63G 4/00 472/29
(Continued)

FOREIGN PATENT DOCUMENTS

DE 29606585 U1 8/1996
EP 0341759 A2 11/1989
(Continued)

OTHER PUBLICATIONS

European Search Report in counterpart application No. EP19201615 dated Jan. 24, 2020.

*Primary Examiner* — Kien T Nguyen
(74) *Attorney, Agent, or Firm* — Oppedahl Patent Law Firm LLC

(57) ABSTRACT

The present invention relates to an amusement ride (1), such as a fairground attraction or an amusement park attraction. The attraction comprises a main carrier (10) rotatable about a first, substantially vertical axis of rotation (R1), a first drive for rotation of the main carrier about the first axis of rotation, at least one passenger carrier (20) which is rotatable about a second, substantially vertical, rotation axis (R2). The passenger carrier is attached to the main carrier at a distance from the first axis of rotation and has a second drive for rotation of the passenger carrier about the second axis of rotation. The passenger carrier is provided with one or more passenger carrier arms with a seat carrier (30) with one or more seats. Each seat carrier is rotatable about a third axis of rotation (R3), which is at an angle of substantially 30 to 70 degrees with respect to the second axis of rotation.

17 Claims, 4 Drawing Sheets

Figure 1:
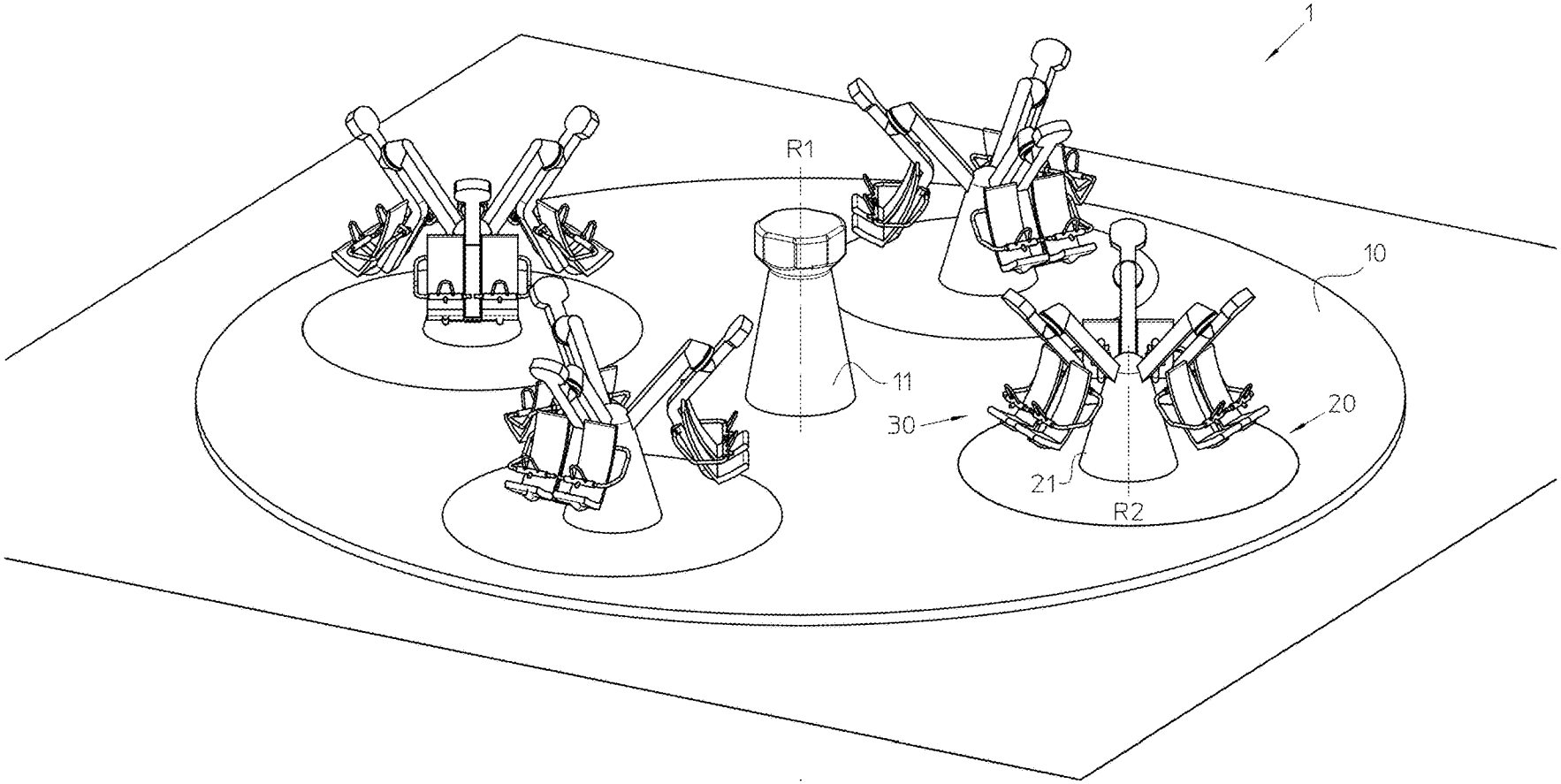

(51) Int. Cl.
*A63G 1/08* (2006.01)
*A63G 31/08* (2006.01)

(58) Field of Classification Search
USPC ..... 472/29, 31–33, 45–47
See application file for complete search history.

(56) References Cited

U.S. PATENT DOCUMENTS

| | | | | |
|---|---|---|---|---|
| 5,395,290 | A * | 3/1995 | Knijpstra | A63G 1/26 297/344.24 |
| 5,791,998 | A | 8/1998 | Moser | |
| 8,721,463 | B2 * | 5/2014 | Zambelli | A63G 1/24 472/31 |
| 8,864,592 | B2 * | 10/2014 | Baxter | A63G 1/26 472/31 |
| 2013/0123030 | A1 | 5/2013 | Jacobi | |

FOREIGN PATENT DOCUMENTS

| | | | |
|---|---|---|---|
| EP | 1559461 | A1 | 8/2005 |
| GB | 2337944 | A | 12/1999 |
| WO | WO 92/07638 | A1 | 5/1992 |

* cited by examiner

ATTRACTION FOR ENTERTAINMENT RIDES

The present invention relates to an amusement ride attraction, such as a fairground attraction or an amusement park attraction, comprising a main carrier rotatable about a first, substantially vertical axis of rotation, a first drive for rotation of the main carrier about the first axis of rotation, at least one passenger carrier rotatable about a second, substantially vertical axis of rotation, in which the passenger carrier is attached to the main carrier at a distance from the first axis of rotation, a second drive for rotation of the passenger carrier about the second axis of rotation, wherein the passenger carrier is provided with one or more passenger carrier arms with a seat carrier with one or more seats, wherein each seat carrier is rotatable about a third axis of rotation.

Such an attraction is known in the art in various variants.

The present invention has for its object to provide an attraction of the type mentioned in the preamble which is more sensational without causing the passengers to move upside-down.

To this end, the attraction according to the invention is characterized in that the third axis of rotation is at an angle of substantially 30 to 70 degrees with respect to the second axis of rotation. This tilt of the third axis of rotation relative to the second axis of rotation provides a sensational combination of rotational movements and gives a passenger a unique experience with more dynamics and a more intense ride experience.

According to a first preferred embodiment, the seats in each seat carrier are at an angle of tilt with respect to the third axis of rotation, wherein the angle of tilt is greater than zero. In this first preferred embodiment, in the entry position, the seat portion of the seat is tilted away from the third axis of rotation and the head end of the seat is tilted towards the third axis of rotation. This combination of two angles gives the passenger the unique feeling of floating during the ride. By using this unique combination of $\alpha$ and $\beta$, the g-forces are more dynamically distributed during the rotation of the seat carrier, ensuring a comfortable ride experience. The passenger is pressed into the seat, while the passenger makes a sensational flight with a relatively large circumference around the third axis of rotation without the g-forces increasing too much. It is known in the relevant field that attractions that completely position the passenger upside down are avoided by a considerable part of the target group. The attraction according to the present invention also makes it possible for this group to experience a dynamic ride with much swung without being positioned completely upside down.

The third axis of rotation is preferably not driven, but freely rotatable, whereby the seat carrier makes unpredictable rotational movements.

More preferably, the third axis of rotation is at an angle of substantially 40 to 50 degrees with respect to the second axis of rotation. In an optimum preferred embodiment, the third axis of rotation is at an angle of substantially 45 degrees with respect to the second axis of rotation.

In an optimum preferred embodiment, the tilt angle $\beta$ is no more than 35 degrees smaller than the angle $\alpha$. With this additional condition in mind, a passenger can safely and comfortably get in and out of the attraction at any choice of angle $\alpha$ in the range $30<\alpha<70$ degrees.

In an elegant preferred embodiment, the main carrier is a platform and the passenger carrier comprises an upright mounted on the platform, wherein the passenger carrier arms are attached to the upright and extend obliquely upward from the upright and the third axis of rotation extends substantially transversely through the passenger carrier arm.

In a variant, the main carrier comprises a number of arms, as well as a first hub, in which the arms are attached to the first hub and extend radially from the first hub, in which the first hub is rotatably mountable around a mast and in which each passenger carrier has a suspension with a second hub, which suspension is attached to one of the arms, wherein the passenger carrier arms are attached to the second hub and extend obliquely downward from the second hub and the third axis of rotation extends substantially longitudinally through the passenger carrier arm.

In a further preferred embodiment, each seat carrier is provided with a seat carrier arm, which is rotatably attached to the passenger carrier arm, in which the third axis of rotation extends transversely through the seat carrier arm. The length of the seat carrier arm partly determines the circumference with which the passenger floats around the third axis of rotation. In a further elaboration, each seat carrier arm is bent at one end and provided with a seat carrier element on which one or more seats are mounted. The tilt angle can be adjusted by means of the degree of the bend.

In an alternative preferred embodiment, the seat carrier arm is provided with a counterweight at a free end thereof, so that the passenger will experience an even more intense experience. With the option of the counterweight, the attraction can be made suitable for different target groups.

The invention will now be described in more detail with reference to the figures.

Figure 2:
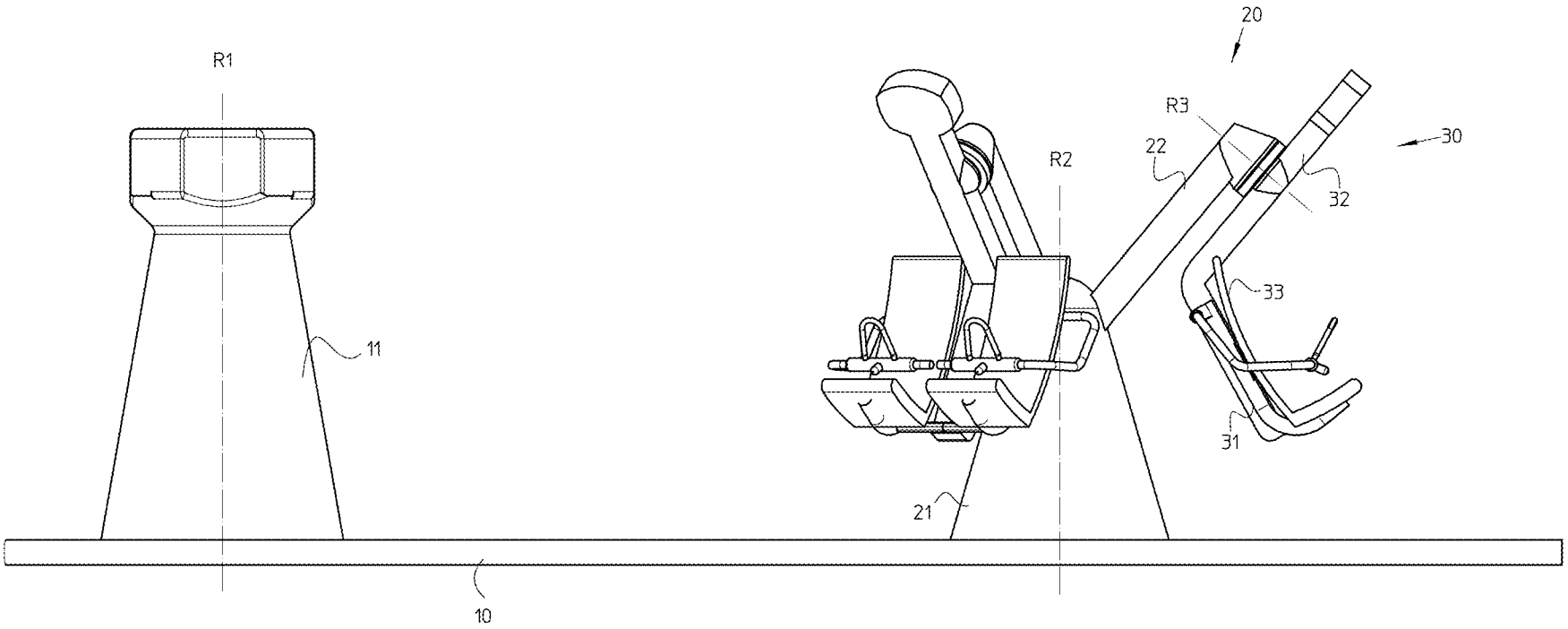
Figure 3B:
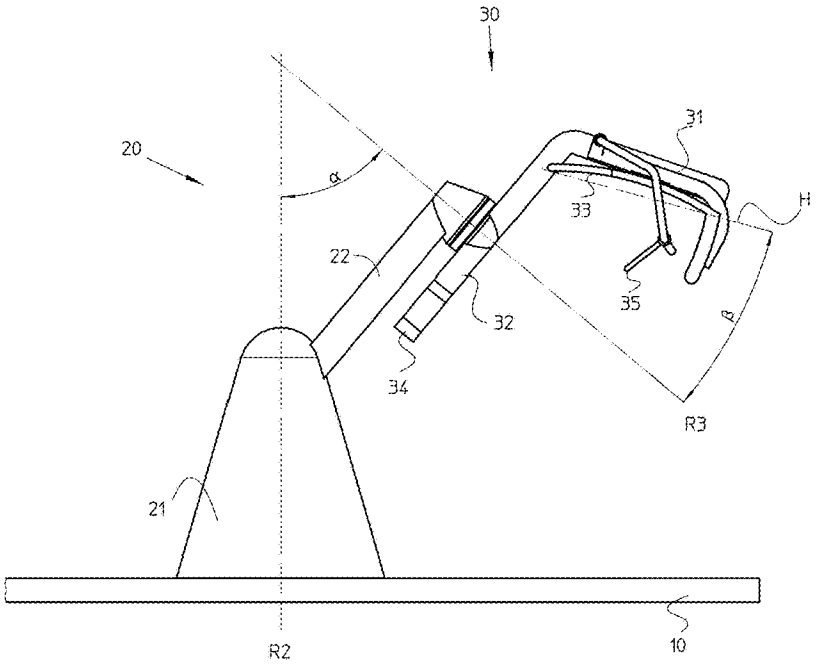
Figure 3A:
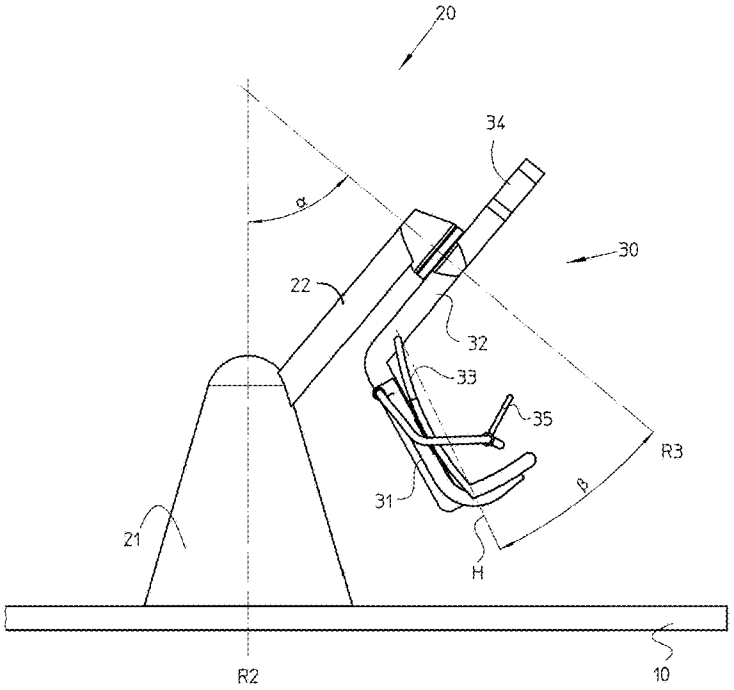
Figure 4:
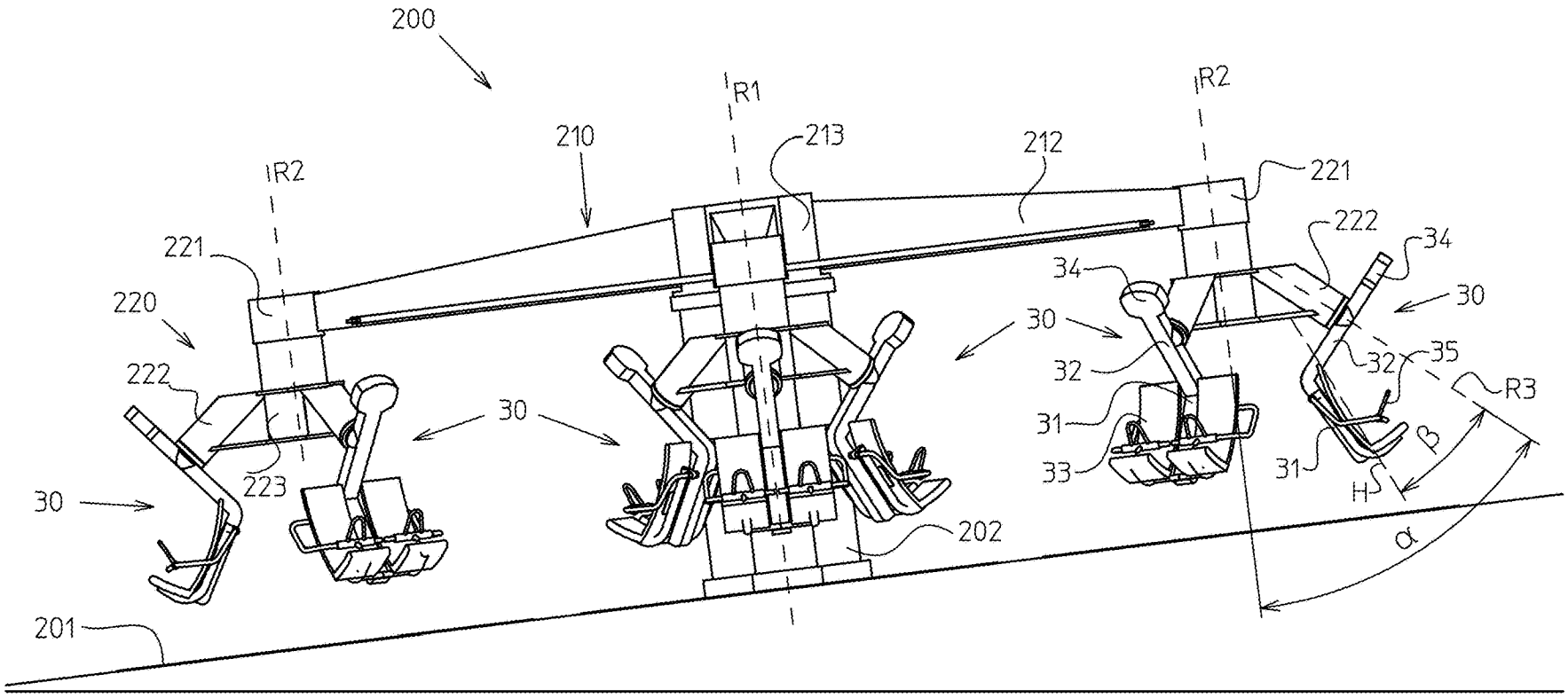

FIG. 1 shows a schematic view of a first preferred embodiment of the attraction according to the invention;

FIG. 2 schematically shows a part of FIG. 1 in more detail;

FIGS. 3A and 3B show a part of FIG. 2 in more detail in two different positions; and FIG. 4 shows a schematic view of a second preferred embodiment of the attraction according to the invention.

FIG. 1 shows a first preferred embodiment of an attraction 1 according to the invention in a schematic view. FIG. 1 shows attraction 1 in a standstill. This is also the start position and the end position and therefore the entry and exit position. FIG. 2 shows a schematic view of a part of FIG. 1 in more detail.

The attraction 1 is an attraction for amusement rides, for example a fairground attraction or an amusement park attraction, and comprises a main carrier 10, which is rotatable about a first, substantially vertical axis of rotation R1. In the first preferred embodiment, the main carrier is a platform 10. A substantially vertical upright 11 is arranged on the platform 10, preferably centrally. The first axis of rotation R1 extends longitudinally through the central upright 11. The attraction 1 comprises a first drive (not shown) for rotation of the main carrier 10 about the first axis of rotation R1.

The attraction 1 is provided with at least one passenger carrier 20, which is rotatable about a second, substantially vertical, axis of rotation R2. In the first preferred embodiment, the passenger carrier 20 comprises an upright 21, which is mounted on the platform 10 at a distance from the central upright 11. The second axis of rotation R2 extends longitudinally through the upright 21. In the first preferred embodiment, the attraction 1 comprises four passenger carriers 20.

The attraction 1 comprises a second drive (not shown) for rotation of the passenger carrier 20 about the second axis of rotation R2.

The passenger carrier 20 is provided with one or more passenger carrier arms 22 to which seat carriers 30 are rotatably mounted. Each seat carrier 30 is rotatable about a third axis of rotation R3. The third axis of rotation R3 extends substantially transversely to the associated passenger carrier arm 22. In the first preferred embodiment, each passenger carrier 20 comprises three passenger carrier arms 22, each of which is provided with a seat carrier 30.

FIGS. 3A and 3B show a part of a passenger carrier 20 with the seat carrier 30 in two different positions. For the sake of clarity, the passenger carrier 20 is shown with only one passenger carrier arm 22 and with only one seat carrier 30.

The third axis of rotation R3 is at an angle $\alpha$ with respect to the second axis of rotation R2, with $\alpha$ in the range of $30<\alpha<70$ degrees. Each passenger carrier arm 22 consequently extends obliquely upwards from the upright 21.

More preferably, $40<\alpha<60$ degrees, for example $\alpha=50$ degrees. In FIGS. 3A and 3B the angle $\alpha$ is 50 degrees.

In the first preferred embodiment, each seat carrier 30 is provided with at least one seat carrier arm 32, which is rotatably attached to the passenger carrier arm 22 and runs at least partially parallel to the passenger carrier arm. The third axis of rotation R3 extends substantially transversely through the passenger carrier arm 22 and the seat carrier arm 32.

The seat carrier arm 32 is bent at one end and provided with a seat carrier element 31 on which one or more seats 33 are mounted. In the first preferred embodiment, each seat carrier arm 32 comprises a seat carrier element 31 with two seats 33.

The seat carrier arm 32 is provided at its opposite free end with a counterweight 34, which is optional.

The seats 33 are at an angle of inclination $\beta$ with respect to the third axis of rotation R3, in which the angle of inclination $\beta$ is greater than zero. The line H represents the average position of the backrest of the seat 33. During the ride that is the average position of the passenger's back. Preferably $\beta$ is in the range $0<\beta\leq50$ degrees. More preferably $\beta$ is in the range $10<\beta<30$ degrees, for example $\beta=20$ degrees. In FIGS. 3A and 3B, the tilt angle $\beta$ is 20 degrees.

In the first preferred embodiment, the seat carrier 30 is freely rotatably suspended on the passenger carrier 20. FIG. 3A shows the seat carrier 30 in the entry and exit position. Rotational axis R3 is preferably provided with a brake to allow passengers to get on and off safely. FIG. 3B shows the seat carrier 30 in the extreme position.

In the first preferred embodiment, the seat 33 is provided with a stomach brace 35.

It is noted that suitable drives are known in the relevant field.

In the attraction according to the invention, each passenger experiences movement along three degrees of freedom of movement during the ride. In the first preferred embodiment, the rotation is driven about the rotation axes R1 and R2 and rotation about the rotation axis R3 is freely rotatable It will be clear that the capacity of the attraction according to the invention can be adapted to the circumstances. This can be done by adjusting the number of seats per seat carrier, the number of seat carriers per passenger carrier and the number of passenger carriers per main carrier.

In addition, it is also possible to replace the platform with uprights by an alternative main carrier on which passenger carriers according to the invention are suspended. These and other variants are within the reach of an expert after reading this text.

FIG. 4 shows an example of a variant 200 with alternative main carrier 210. In FIG. 4, the same parts are designated with the same reference numerals. The reference numbers of parts which have an alternative embodiment for performing the same function are incremented by the number 200. On platform 201 there is a mast 202 with the main carrier 210, comprising a first hub 213 and arms 212, which are attached to a first hub 213 and extend radially from the first hub. The first hub is rotatably mounted about the mast 202. The first axis of rotation R1 extends longitudinally through the mast 202. A passenger carrier 220 is attached to the end of each arm 212. Each passenger carrier 220 has a suspension 221 provided with a second hub 223, which is rotatably attached to the suspension 221. The second axis of rotation R2 extends longitudinally through the suspension 221. Each passenger carrier 220 further comprises one or more passenger carrier arms 222 to which the seat carriers 30 of the first preferred embodiment are rotatably mounted. Each seat carrier 30 is rotatable about a third axis of rotation R3. The third axis of rotation R3 extends substantially in the longitudinal direction through the associated passenger carrier arm 222.

In the variant of FIG. 4, $\alpha=45$ degrees and $\beta=25$ degrees.

The angle $\alpha$ can assume all values between 30 and 70 degrees. The choice for the value of the tilt angle $\beta$ is related to the choice for the angle $\alpha$. For proper functioning $\beta\leq\alpha$. The difference between $\alpha$ and $\beta$ should also be a maximum of 35 degrees.

At various known attractions, the third axis of rotation runs almost vertically or horizontally through the passenger, the back position of which is shown with the H-line.

The attraction according to the present invention is distinguished by the fact that the seat carrier is mounted at some distance from the third rotation axis at an angle of tilt with respect to this third rotation axis. As a result, the H line does not coincide with the third axis of rotation.

The invention is therefore not limited to the described and shown preferred embodiments, but extends to any embodiment that falls within the scope of the scope of protection as defined in the claims and viewed in the light of the foregoing description and accompanying drawings.

The invention claimed is:

1. An amusement ride attraction, comprising a main carrier rotatable about a first, substantially vertical, axis of rotation, a first drive for rotating the main carrier about the first axis of rotation, at least one passenger carrier that is rotatable around a second, substantially vertical fixed axis of rotation, in which the passenger carrier is attached to the main carrier at a distance from the first axis of rotation, a second drive for rotation of the passenger carrier around the second axis of rotation, in which the passenger carrier is provided with one or more passenger carrier arms having a seat carrier with one or more seats, in which each seat carrier is rotatable about a third fixed axis of rotation, wherein the third axis of rotation is at an angle $\alpha$ of substantially 30 to 70 degrees with respect to the second axis of rotation, wherein the seats in each seat carrier are at an angle of tilt $\beta$ with respect to the third axis of rotation, wherein $0<\beta\leq\alpha$.

2. The attraction of claim 1, wherein the third axis of rotation is at an angle of substantially 40 to 60 degrees with respect to the second axis of rotation.

3. The attraction of claim 1, wherein the third axis of rotation is at an angle of substantially 40 to 50 degrees with respect to the second axis of rotation.

4. The attraction of claim 3, wherein the third axis of rotation is at an angle of substantially 45 degrees.

5. The attraction of claim 1, wherein the tilt angle β is no more than 35 degrees smaller than the angle α.

6. The attraction of claim 1, wherein the tilt angle is substantially 0 to 50 degrees.

7. The attraction of claim 1, wherein the tilt angle is substantially 10 to 40 degrees.

8. The attraction of claim 1, wherein the tilt angle is substantially 20 to 30 degrees.

9. The attraction of claim 8, wherein the tilt angle is substantially 25 degrees.

10. The attraction of claim 1, wherein the third axis of rotation is freely rotatable.

11. The attraction of claim 1, wherein the main carrier is a platform and wherein the passenger carrier comprises an upright mounted on the platform, wherein the passenger carrier arms are attached to the upright and extend obliquely upward from the upright and the third axis of rotation extends substantially transversely through the passenger carrier arm.

12. The attraction of claim 1, wherein the main carrier comprises a plurality of arms, as well as a first hub, wherein the arms are attached to the first hub and extend radially from the first hub, wherein the first hub is rotatably mountable about a mast and wherein each passenger carrier comprises a suspension with a second hub, which suspension is attached to one of the arms, in which the passenger carrier arms are attached to the second hub and extend obliquely downwards from the second hub and the third axis of rotation extends substantially longitudinally through the passenger carrier arm.

13. The attraction of claim 1, wherein each seat carrier comprises a seat carrier arm rotatably mounted to the passenger carrier arm, wherein the third axis of rotation extends transversely through the seat carrier arm.

14. The attraction of claim 13, wherein each seat carrier arm is bent at one end and is provided with a seat carrier element on which one or more seats are mounted.

15. The attraction of claim 13, wherein the seat carrier arm is provided with a counterweight at a free end thereof.

16. The attraction of claim 1, wherein the attraction is a fairground attraction.

17. The attraction of claim 1, wherein the attraction is an amusement park attraction.

* * * * *